US007617871B2

(12) United States Patent
Surjaatmadja et al.

(10) Patent No.: US 7,617,871 B2
(45) Date of Patent: Nov. 17, 2009

(54) HYDRAJET BOTTOMHOLE COMPLETION TOOL AND PROCESS

(75) Inventors: Jim B. Surjaatmadja, Duncan, OK (US); Matt Howell, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 142 days.

(21) Appl. No.: 11/668,011

(22) Filed: Jan. 29, 2007

(65) Prior Publication Data

US 2008/0179060 A1 Jul. 31, 2008

(51) Int. Cl.
*E21B 43/00* (2006.01)

(52) U.S. Cl. ..... 166/298; 166/308.1; 166/223

(58) Field of Classification Search ..... 166/297, 166/298, 177.5, 222, 308.1, 185, 186, 191, 166/177.1, 271, 55
See application file for complete search history.

(56) References Cited

U.S. PATENT DOCUMENTS

| | | | | |
|---|---|---|---|---|
| 4,378,842 | A * | 4/1983 | Patel | 166/278 |
| 5,061,508 | A | 10/1991 | Schur et al. | |
| 5,133,226 | A | 7/1992 | Miller | |
| 5,263,284 | A | 11/1993 | Wild | |
| 5,394,938 | A * | 3/1995 | Cornette et al. | 166/51 |
| 5,499,687 | A * | 3/1996 | Lee | 175/317 |
| 5,765,642 | A * | 6/1998 | Surjaatmadja | 166/297 |
| 5,908,267 | A | 6/1999 | Schuring et al. | |
| 6,012,517 | A * | 1/2000 | Schuring et al. | 166/53 |
| 6,394,184 | B2 * | 5/2002 | Tolman et al. | 166/281 |
| 6,494,261 | B1 | 12/2002 | Pahmlyer | |
| 6,520,255 | B2 * | 2/2003 | Tolman et al. | 166/281 |

(Continued)

FOREIGN PATENT DOCUMENTS

| | | |
|---|---|---|
| EP | 1 275 815 | 1/2003 |

(Continued)

OTHER PUBLICATIONS

Chilingarian, G.V.; Donaldson, E.C.; Yen, T.F. Subsidence Due to Fluid Withdrawal. (pp. 293). Elsevier. Online version available at: http://knovel.com/web/portal/browse/ display?_EXT_KNOVEL_DISPLAY_bookid+1913 &VerticalID=0.*

(Continued)

*Primary Examiner*—David J Bagnell
*Assistant Examiner*—James G Sayre
(74) *Attorney, Agent, or Firm*—John W. Wustenberg; Baker Botts, LLP

(57) ABSTRACT

Of the many assemblies and methods provided herein, one assembly includes a conduit adapted for installation in a well bore in a subterranean formation; one or more fluid jet forming nozzles disposed about the conduit; and one or more windows formed in the conduit and adapted to selectively allow a flow of a fluid through at least one of the one or more fluid jet forming nozzles. Another assembly provided herein includes a conduit adapted for installation in a well bore in a subterranean formation; one or more fluid jet forming nozzles disposed about the conduit; a fluid delivery tool disposed within the conduit, wherein the fluid delivery tool is operable to move along the conduit; a straddle assembly operable to substantially isolate the fluid delivery tool from an annulus formed between the fluid delivery tool and the conduit; and wherein the conduit comprises one or more permeable liners.

12 Claims, 8 Drawing Sheets

U.S. PATENT DOCUMENTS

| | | | | |
|---|---|---|---|---|
| 6,732,793 | B1 * | 5/2004 | Lee | 166/222 |
| 6,957,701 | B2 * | 10/2005 | Tolman et al. | 166/281 |
| 7,059,407 | B2 * | 6/2006 | Tolman et al. | 166/281 |
| 7,066,264 | B2 * | 6/2006 | Bissonnette et al. | 166/305.1 |
| 7,066,265 | B2 * | 6/2006 | Surjaatmadja | 166/308.1 |
| 7,287,596 | B2 * | 10/2007 | Frazier et al. | 166/332.8 |
| 2006/0000610 | A1 * | 1/2006 | Farabee et al. | 166/281 |
| 2007/0284106 | A1 * | 12/2007 | Kalman et al. | 166/298 |

FOREIGN PATENT DOCUMENTS

| | | | |
|---|---|---|---|
| EP | 1275815 | * | 1/2003 |

OTHER PUBLICATIONS

U.S. Appl. No. 11/430,634, filed May 9, 2006, Surjaatmadja.
U.S. Appl. No. 11/430,679, filed May 9, 2006, Surjaatmadja.
Foreign communication related to a counterpart application dated Apr. 4, 2008.

* cited by examiner

HYDRAJET BOTTOMHOLE COMPLETION TOOL AND PROCESS

BACKGROUND

The present invention relates generally to subterranean treatment operations, and more particularly to methods of isolating local areas of interest for subterranean treatment operations.

In some wells, it may be desirable to individually and selectively create multiple fractures along a well bore at a distance apart from each other. The multiple fractures should have adequate conductivity, so that the greatest possible quantity of hydrocarbons in an oil and gas reservoir can be drained/produced into the well bore. When stimulating a reservoir from a well bore, especially those well bores that are highly deviated or horizontal, it may be difficult to control the creation of multi-zone fractures along the well bore without cementing a liner to the well bore and mechanically isolating the subterranean formation being fractured from previously-fractured formations, or formations that have not yet been fractured.

One conventional method for fracturing a subterranean formation penetrated by a well bore has involved cementing a solid liner in the lateral section of the well bore, performing a conventional explosive perforating step, and then performing fracturing stages along the well bore. Another conventional method has involved cementing a liner and significantly limiting the number of perforations, often using tightly-grouped sets of perforations, with the number of total perforations intended to create a flow restriction giving a back-pressure of about 100 psi or more; in some instances, the back-pressure may approach about 1000 psi flow resistance. This technology generally is referred to as "limited-entry" perforating technology.

In one conventional method of fracturing, a first region of a formation is perforated and fractured, and a sand plug then is installed in the well bore at some point above the fracture, e.g., toward the heel. The sand plug may restrict any meaningful flow to the first region of the formation, and thereby may limit the loss of fluid into the formation, while a second, upper portion of a formation is perforated and fracture-stimulated. Coiled tubing may be used to deploy explosive perforating guns to perforate subsequent treatment intervals while maintaining well control and sand-plug integrity. Conventionally, the coiled tubing and perforating guns are removed from the well before subsequent fracturing stages are performed. Each fracturing stage may end with the development of a sand plug across the perforations by increasing the sand concentration and simultaneously reducing pumping rates until a bridge is formed. Increased sand plug integrity may be obtained by performing what is commonly known in the cementing services industry as a "hesitation squeeze" technique. A drawback of this technique, however, is that it requires multiple trips to carry out the various stimulation and isolation steps.

The pressure required to continue propagation of a fracture present in a subterranean formation may be referred to as the "fracture propagation pressure." Conventional perforating operations and subsequent fracturing operations undesirably may cause the pressure to which the subterranean formation is exposed to fall below the fracture propagation pressure for a period of time. In certain embodiments of conventional perforating and fracturing operations, the formation may be exposed to pressures that oscillate above and below the fracture propagation pressure. For example, if a hydrajetting operation is halted temporarily, e.g., in order to remove the hydrajetting tool, or to remove formation cuttings from the well bore before continuing to pump the fracturing fluid, then the formation may experience a pressure cycle.

Pressure cycling may be problematic in sensitive formations. For example, certain subterranean formations may shatter upon exposure to pressure cycling during a fracturing operation, which may result in the creation of numerous undesirable microfractures, rather than one dominant fracture. Still further, certain conventional perforation operations (e.g., perforations performed using wireline tools) often may damage a sensitive formation, shattering it in the area of the perforation so as to reduce the likelihood that subsequent fracturing operations may succeed in establishing a single, dominant fracture.

SUMMARY

The present invention relates generally to subterranean treatment operations, and more particularly to methods of isolating local areas of interest for subterranean treatment operations.

In one embodiment, the present invention provides a bottomhole completion assembly comprising: a conduit adapted for installation in a well bore in a subterranean formation; one or more fluid jet forming nozzles disposed about the conduit; and one or more windows formed in the conduit and adapted to selectively allow a flow of a fluid through at least one of the one or more fluid jet forming nozzles.

In another embodiment, the present invention provides a bottomhole completion assembly comprising: a conduit adapted for installation in a well bore in a subterranean formation; one or more fluid jet forming nozzles disposed about the conduit; a fluid delivery tool disposed within the conduit, wherein the fluid delivery tool is operable to move along the conduit; a straddle assembly operable to substantially isolate the fluid delivery tool from an annulus formed between the fluid delivery tool and the conduit; and wherein the conduit comprises one or more permeable liners.

In another embodiment, the present invention provides a method of bottomhole completion in a subterranean formation comprising: providing a conduit adapted for installation in a well bore in a subterranean formation; providing one or more fluid jet forming nozzles disposed about the conduit; providing one or more windows adapted to selectively allow a flow of a fluid through the one or more fluid jet forming nozzles; and conducting a well completion operation.

In another embodiment, the present invention provides a method of bottomhole completion in a subterranean formation comprising: providing a conduit adapted for installation in a well bore in a subterranean formation; providing one or more fluid jet forming nozzles disposed about the conduit; providing a fluid delivery tool disposed within the conduit, wherein the fluid delivery tool is operable to move along the conduit; providing a straddle assembly operable to substantially isolate the fluid delivery tool from an annulus formed between the fluid delivery tool and the conduit, wherein the conduit comprises one or more permeable liners; and conducting a well completion operation.

The features and advantages of the present invention will be readily apparent to those skilled in the art. While numerous changes may be made by those skilled in the art, such changes are within the spirit of the invention.

BRIEF DESCRIPTION OF THE DRAWINGS

FIG. 2A depicts the illustrative window casing in a closed position. FIG. 2B depicts the illustrative window casing in an open position.

FIG. 4A depicts the perforation and fracture of a subterranean formation. FIG. 4B depicts production from a subterranean formation.

FIG. 5B depicts the perforation and fracture of a subterranean formation. FIG. 5C depicts production from a subterranean formation.

DETAILED DESCRIPTION

Figure 1:
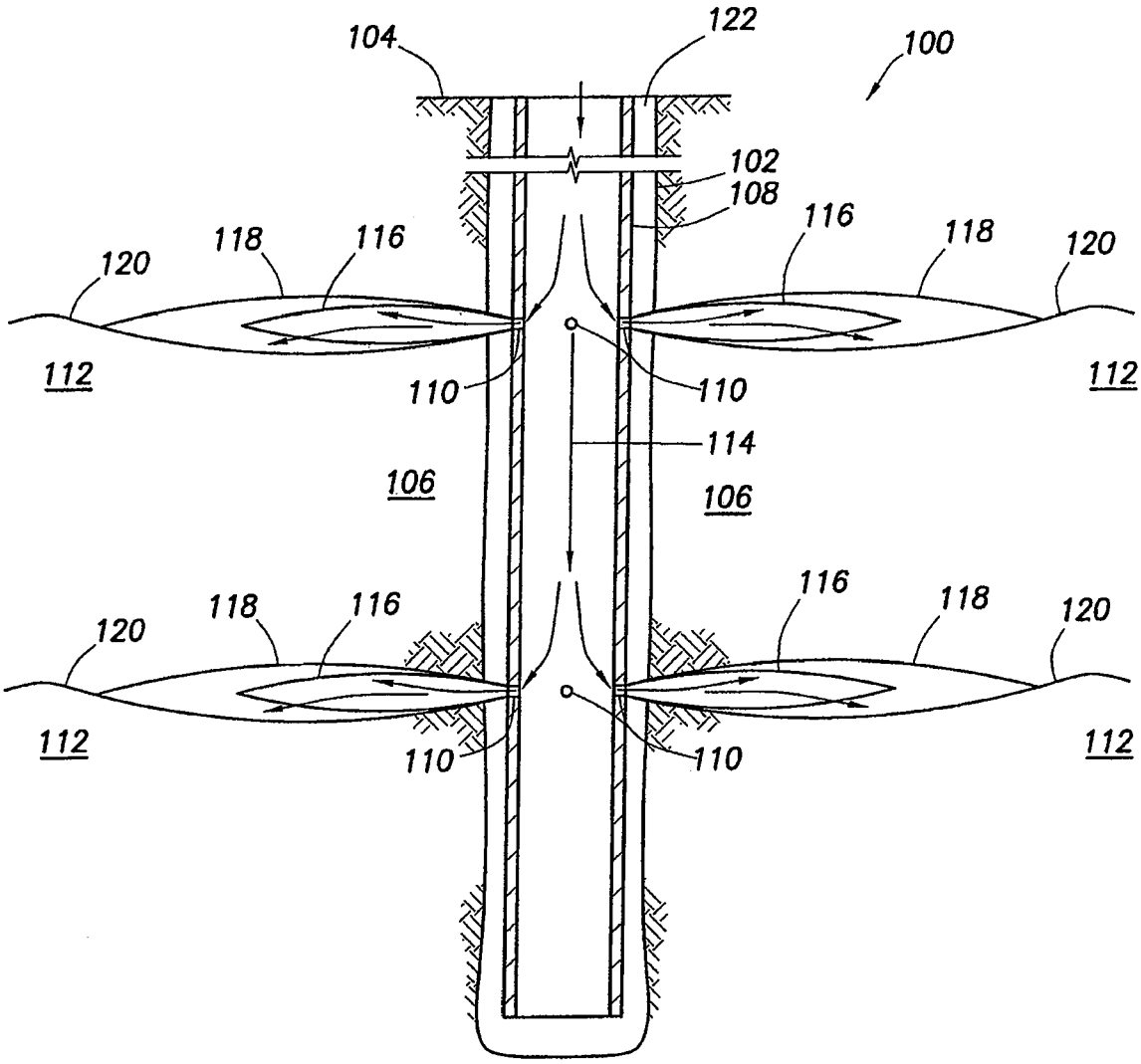
FIG. 1 is a schematic cross-sectional view of an illustrative well completion assembly illustrating the perforation of a subterranean formation.

Referring now to FIG. 1, an illustrative completion assembly 100 includes a well bore 102 coupled to the surface 104 and extending down through a subterranean formation 106. Well bore 102 may drilled into subterranean formation 106 using conventional (or future) drilling techniques and may extend substantially vertically away from surface 104 or may deviate at any angle from the surface 104. In some instances, all or portions of well bore 102 may be vertical, deviated, horizontal, and/or curved.

Conduit 108 may extend through at least a portion of well bore 102. In some embodiments, conduit 108 may be part of a casing string coupled to the surface 104. In some embodiments conduit 108 may be a liner that is coupled to a previous casing string. Conduit 108 may or may not be cemented to subterranean formation 106. When uncemented, conduit 108 may contain one or more permeable liners, or it may be a solid liner. As used herein, the term "permeable liner" includes, but is not limited to, screens, slots and preperforations. Those of ordinary skill in the art, with the benefit of this disclosure, will recognize whether conduit 108 should be cemented or uncemented and whether conduit 108 should be contain one or more permeable liners.

Conduit 108 includes one or more fluid jet forming nozzles 110. As used herein, the term "fluid jet forming nozzle" refers to any fixture that may be coupled to an aperture so as to allow the communication of a fluid therethrough such that the fluid velocity exiting the jet is higher than the fluid velocity at the entrance of the jet. In some embodiments, fluid jet forming nozzles 110 may be longitudinally spaced along conduit 108 such that when conduit 108 is inserted into well bore 102, fluid jet forming nozzles 110 will be adjacent to a local area of interest, e.g., zones 112 in subterranean formation 106. As used herein, the term "zone" simply refers to a portion of the formation and does not imply a particular geological strata or composition. As will be recognized by those of ordinary skill in the art, with the benefit of this disclosure, conduit 108 may have any number of fluid jet forming nozzles, configured in a variety of combinations along and around conduit 108.

Once well bore 102 has been drilled and, if deemed necessary, cased, a fluid 114 may be pumped into conduit 108 and through fluid jet forming nozzles 110 to form fluid jets 116. In one embodiment, fluid 114 is pumped through fluid jet forming nozzles 110 at a velocity sufficient for fluid jets 116 to form perforation tunnels 118. In one embodiment, after perforation tunnels 118 are formed, fluid 114 is pumped into conduit 108 and through fluid jet forming nozzles 110 at a pressure sufficient to form cracks or fractures 120 along perforation tunnels 118.

As will be recognized by those of ordinary skill in the art, with the benefit of this disclosure, the composition of fluid 114 may be changed to enhance properties desirous for a given function, i.e., the composition of fluid 114 used during fracturing may be different than that used during perforating. In certain embodiments of the present invention, an acidizing fluid may be injected into formation 106 through conduit 108 after perforation tunnels 118 have been created, and shortly before (or during) the initiation of cracks or fractures 120. The acidizing fluid may etch formation 106 along cracks or fractures 120, thereby widening them. In certain embodiments, the acidizing fluid may dissolve fines, which further may facilitate flow into cracks or fractures 120. In another embodiment of the present invention, a proppant may be included in fluid 114 being flowed into cracks or fractures 120, which proppant may prevent subsequent closure of cracks or fractures 120.

For embodiments wherein conduit 108 is not cemented to subterranean formation 106, annulus 122 may be used in conjunction with conduit 108 to pump fluid 114 into subterranean formation 106. Annulus 122 may also be used to take returns of fluid 114 during the formation of perforation tunnels 118. Annulus 122 may also be closed by any suitable means (e.g., by closing a valve, (not shown) at surface 104). Furthermore, those of ordinary skill in the art, with the benefit of this disclosure, will recognize whether annulus 122 should be closed.

Figure 2A:
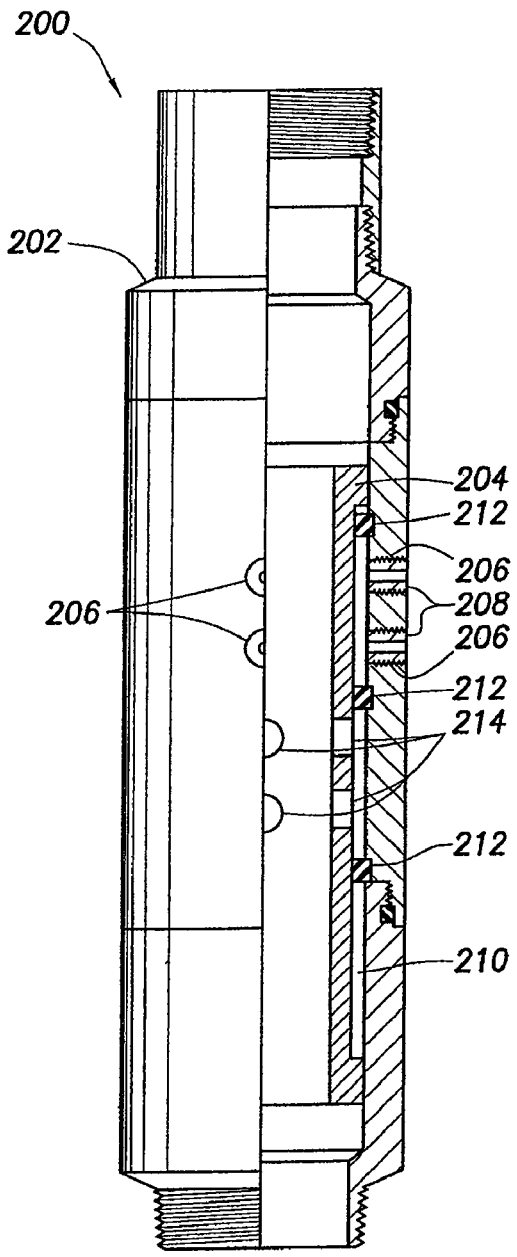
FIGS. 2A and 2B are schematic cross-sectional views showing an illustrative window casing assembly according to the present invention.
Figure 2B:
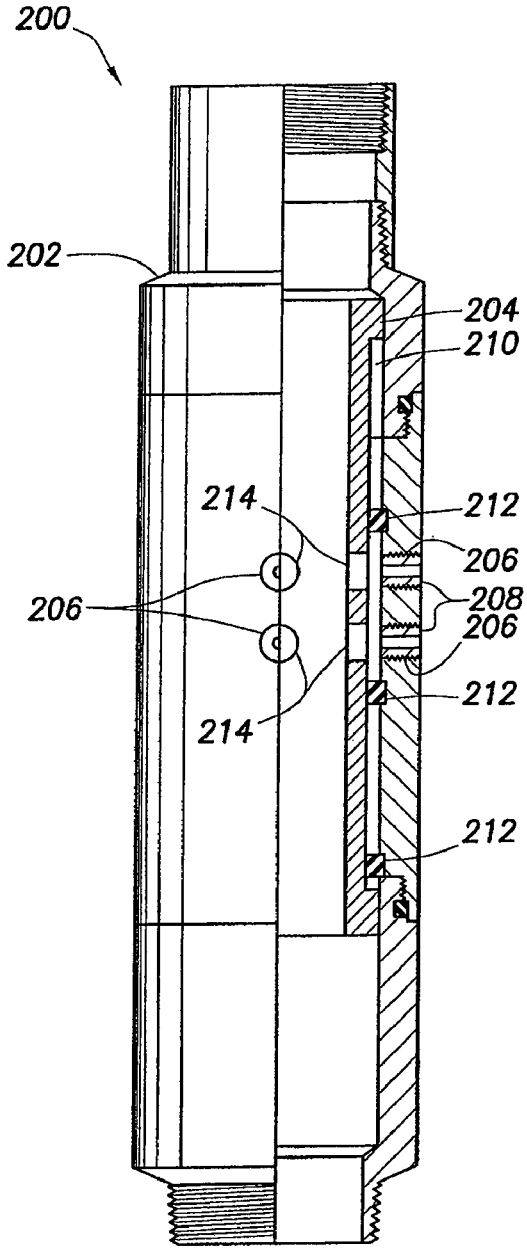

Referring now to FIGS. 2A and 2B, an illustrative window casing assembly 200 is shown as adapted for use in the present invention. As used herein, the term "window casing" refers to a section of casing configured to enable selective access to one or more specified zones of an adjacent subterranean formation. As will be recognized by one of ordinary skill in the art, with the benefit of this disclosure, a window casing has a window that may be selectively opened and closed by an operator, for example, movable sleeve member 204. As will be recognized by one of ordinary skill in the art, with the benefit of this disclosure, window casing assembly 200 can have numerous configurations and can employ a variety of mechanisms to selectively access one or more specified zones of an adjacent subterranean formation. Illustrative window casing 200 includes a substantially cylindrical outer casing 202 that receives a movable sleeve member 204. Outer casing 202 includes one or more apertures 206 to allow the communication of a fluid from the interior of outer casing 202 into an adjacent subterranean formation (not shown). Apertures 206 are configured such that fluid jet forming nozzles 208 may be coupled thereto. In some embodiments, e.g. illustrative window casing assembly 200, fluid jet forming nozzles 208 may be threadably inserted into apertures 206. Fluid jet forming nozzles 208 may be isolated from the annulus 210 (formed between outer casing 202 and movable sleeve member 204) by coupling seals or pressure barriers 212 to outer casing 202.

Movable sleeve member 204 includes one or more apertures 214 configured such that, as shown in FIG. 2A, apertures 214 may be selectively misaligned with apertures 206 so as to prevent the communication of a fluid from the interior of movable sleeve member 204 into an adjacent subterranean formation (not shown). Movable sleeve member 204 may be shifted axially, rotatably, or by a combination thereof such that, as shown in FIG. 2B, apertures 214 selectively align with apertures 206 so as to allow the communication of a fluid from the interior of movable sleeve member 204 into an adjacent subterranean formation. Movable sleeve member 204 may be shifted via the use of a shifting tool, a hydraulic activated mechanism, or a ball drop mechanism.

Figure 3A:
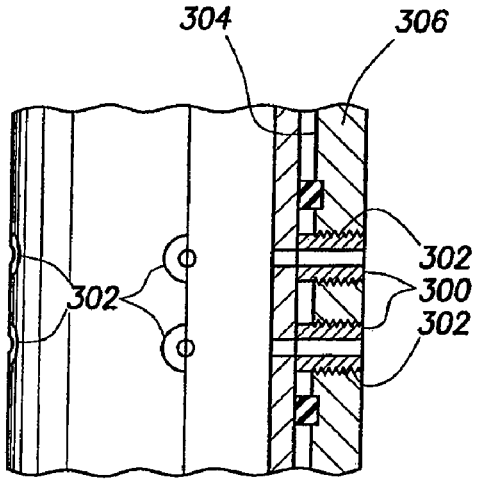
FIGS. 3A-3D are schematic cross-sectional views illustrating various placements of fluid jet forming nozzles in the embodiment illustrated in FIGS. 2A and 2B.
Figure 3B:
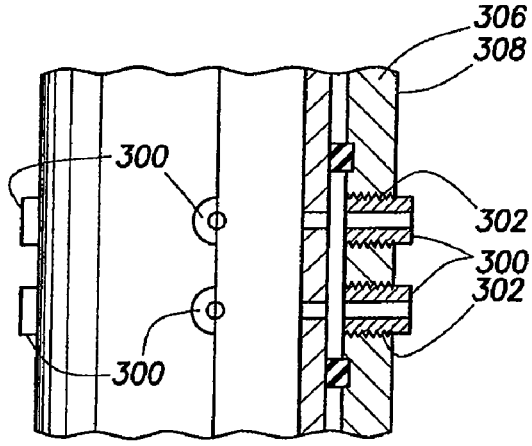
Figure 3C:
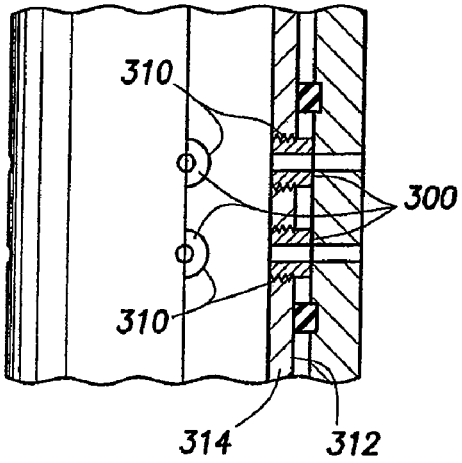
Figure 3D:
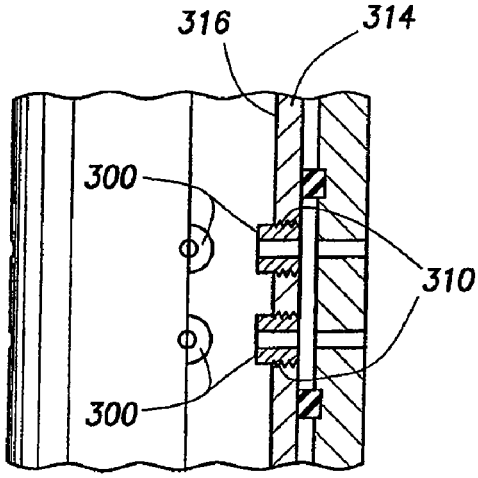

Referring now to FIGS. 3A-3D, a window casing assembly adapted for use in the present invention, e.g., illustrative window casing assembly 200 depicted in FIGS. 2A and 2B, may include fluid jet forming nozzles 300 in a variety of configurations. FIG. 3A shows fluid jet forming nozzles 300 coupled to apertures 302 via the interior surface 304 of outer casing 306. FIG. 3B shows fluid jet forming nozzles 300 coupled to apertures 302 via the exterior surface 308 of outer casing 306. FIG. 3C shows fluid jet forming nozzles 300 coupled to apertures 310 via the exterior surface 312 of movable sleeve member 314. FIG. 3D shows fluid jet forming nozzles 300 coupled to apertures 310 via the interior surface 316 of movable sleeve member 314.

Figure 4A:
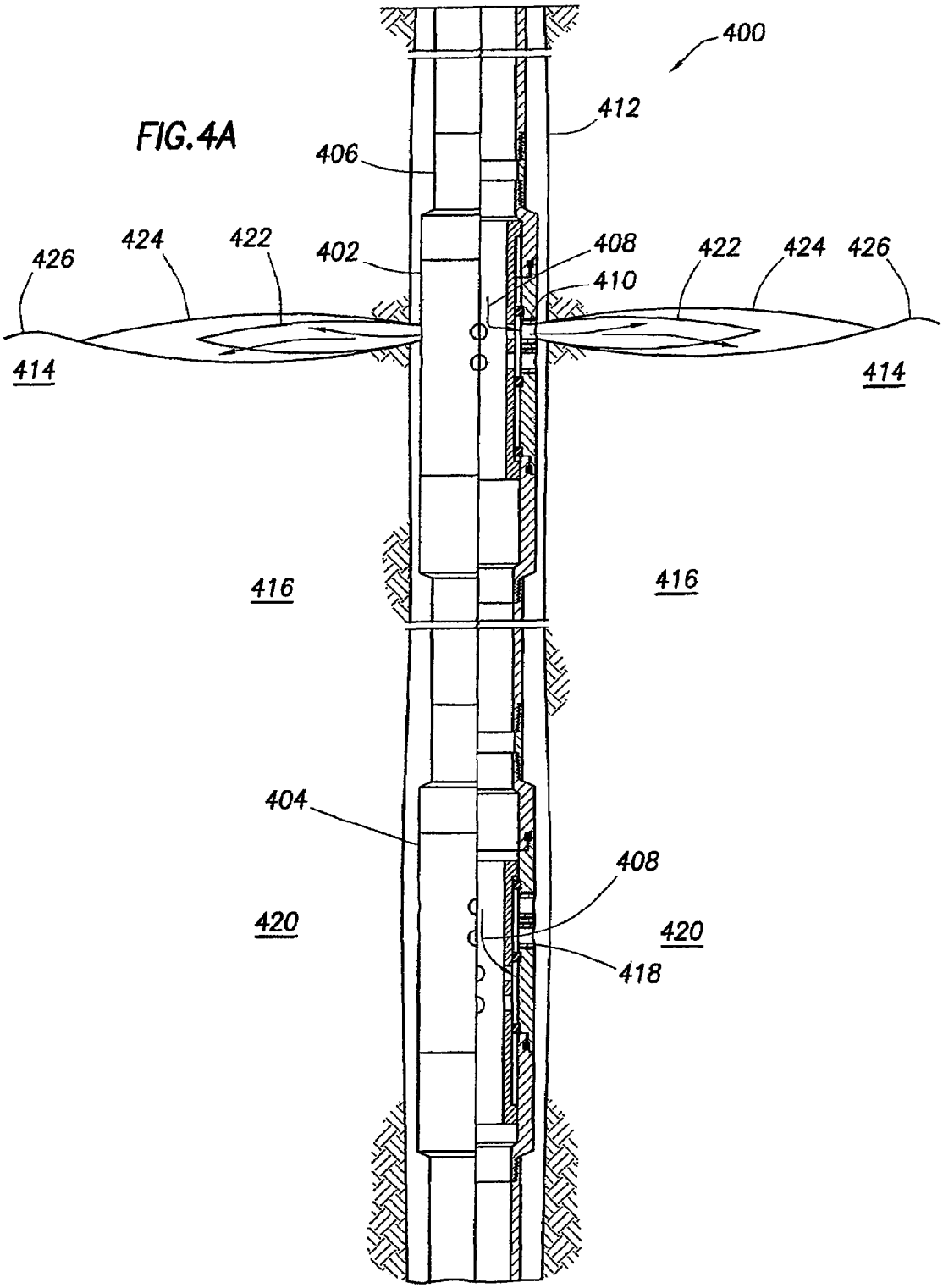
FIGS. 4A and 4B are schematic cross sectional views of an illustrative well completion assembly constructed in accordance with the embodiment depicted in FIGS. 2A and 2B.

Referring now to FIG. 4A, an illustrative well completion assembly 400 includes open window casing 402 and closed window casing 404 formed in conduit 406. Alternatively, illustrative well completion assembly 400 may be selectively configured such that window casing 404 is open and window casing 402 is closed, such that window casings 402 and 404 are both open, or such that window casings 402 and 404 are both closed.

A fluid 408 may be pumped down conduit 406 and be communicated through fluid jet forming nozzles 410 of open window casing 402 against the surface of well bore 412 in zone 414 of subterranean formation 416. Fluid 408 would not be communicated through fluid jet forming nozzles 418 of closed window casing 404, thereby isolating zone 420 of subterranean formation 416 from any well completion operations being conducted through open window casing 402 involving zone 414.

In one embodiment, fluid 408 is pumped through fluid jet forming nozzles 410 at a velocity sufficient for fluid jets 422 to form perforation tunnels 424. In one embodiment, after perforation tunnels 424 are formed, fluid 408 is pumped into conduit 406 and through fluid jet forming nozzles 410 at a pressure sufficient to form cracks or fractures 426 along perforation tunnels 424.

Figure 4B:
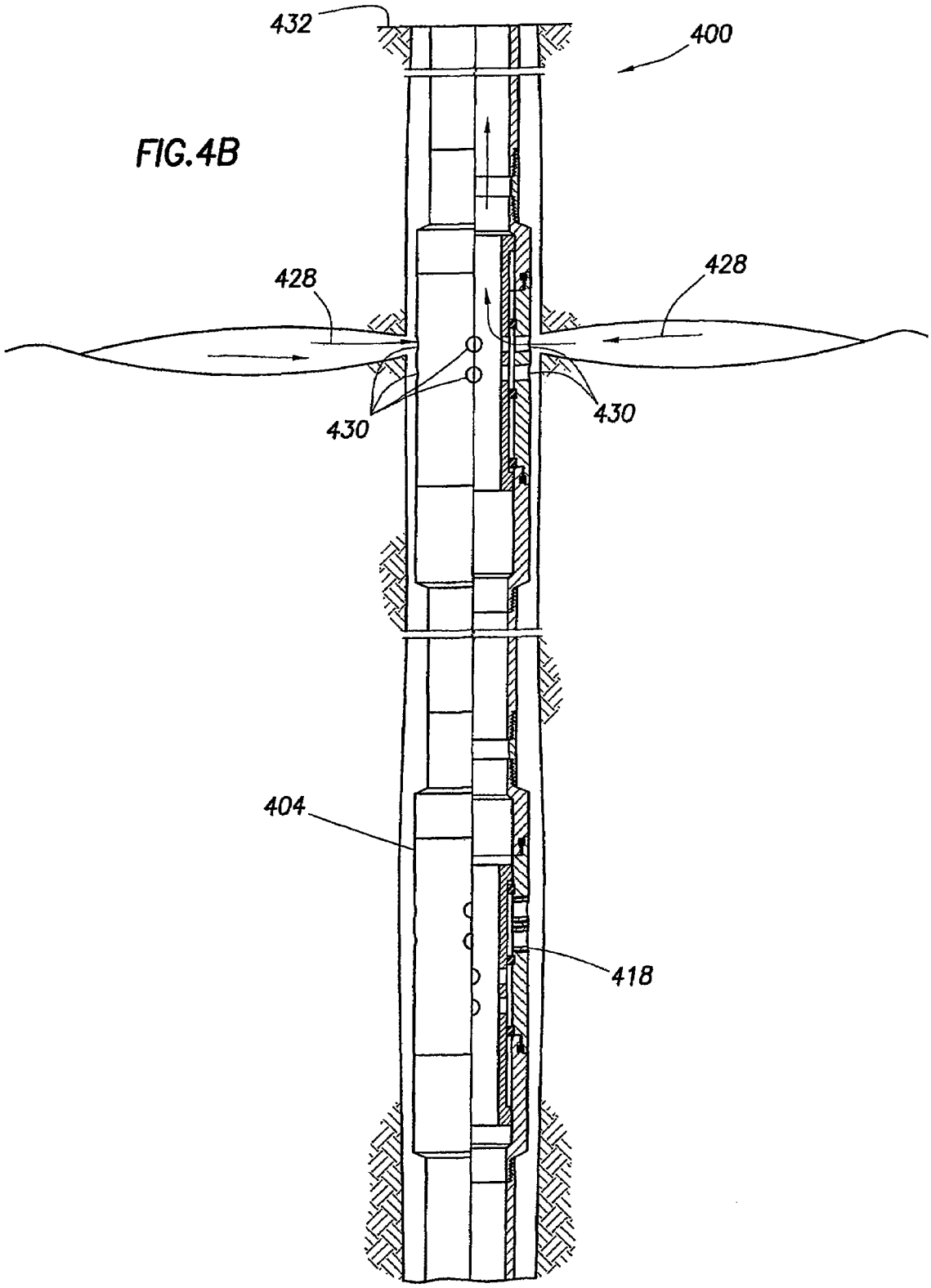

In some embodiments, the fluid jet forming nozzles 410 may be formed of a composition selected to gradually deteriorate during the communication of fluid 408 from conduit 406 into subterranean formation 416. As used herein, the term "deteriorate" includes any mechanism that causes fluid jet forming nozzles to erode, dissolve, diminish, or otherwise degrade. For example, fluid jet forming nozzles 410 may be composed of a material that will degrade during perforation, fracture, acidizing, or stimulation, thereby allowing production fluid 428, shown in FIG. 4B, to flow from subterranean formation 416, through apertures 430, and up conduit 406 to the surface 432. By way of example, and not of limitation, some embodiments may utilize abrasive components in fluid 408 to cut the adjacent formation. In such embodiments, fluid jet forming nozzles 410 may be composed of soft materials such as common steel; such that the abrasive components of fluid 408 may erode fluid jet forming nozzles 410. Some embodiments may incorporate an acid into fluid 408. In such embodiments, fluid jet forming nozzles 410 may be composed of an acid soluble material such as aluminum. Other suitably acid prone materials may include ceramic materials, such as alumina, depending on the structure and/or binders of the ceramic materials. A person of ordinary skill in the art, with the benefit of this disclosure, will be aware of additional combinations of materials to form fluid jet forming nozzles 410 and compositions of fluid 408, such that fluid jet forming nozzles 410 will deteriorate when subject to the communication of fluid 408 therethrough. Thus an operator may engage in stimulation and production activities with regard to zones 414 and 420 both selectively and jointly.

Figure 5:
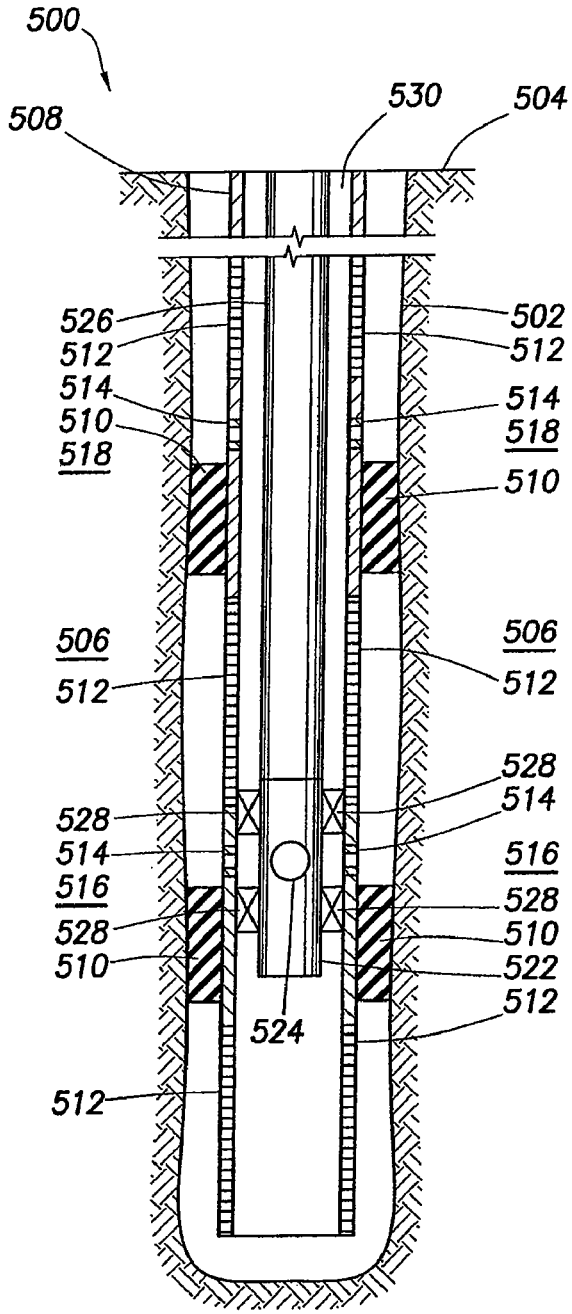
FIG. 5 is a schematic cross-sectional view of an illustrative well completion assembly according to one embodiment of the present invention. Inset 5A shows an embodiment of the fluid jet forming nozzles described herein.
Figure 5A:
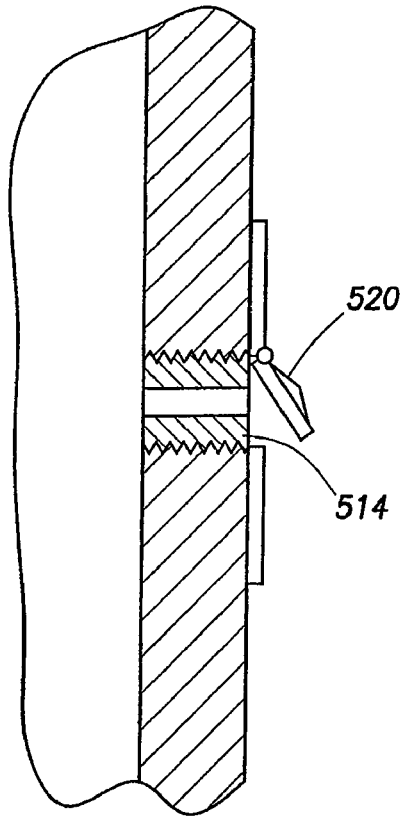
FIGS. 5B and 5C illustrate the use of the embodiment illustrated in FIG. 5 in well completion operations.

Referring now to FIG. 5, an illustrative completion assembly 500 includes a well bore 502 coupled to the surface 504 and extending down through a subterranean formation 506. Well bore 502 may be drilled into subterranean formation 506 using conventional (or future) drilling techniques and may extend substantially vertically away from surface 504 or may deviate at any angle from the surface 504. In some instances, all or portions of well bore 502 may be vertical, deviated, horizontal, and/or curved.

Conduit 508 may extend through at least a portion of well bore 502. In some embodiments, conduit 508 may be part of a casing string coupled to the surface 504. In some embodiments conduit 508 may be a liner that is coupled to a previous casing string. Conduit 508 may or may not be secured in well bore 502. When secured, conduit 508 may be secured by casing packers 510, or it may be cemented to subterranean formation 506. When cemented, conduit 508 may be secured to subterranean formation 506 using an acid soluble cement. When uncemented, conduit 508 may be a solid liner or it may be a liner that includes one or more permeable liners 512. Those of ordinary skill in the art, with the benefit of this disclosure, will recognize whether and how conduit 508 should be secured to well bore 502 and whether conduit 508 should include one or more permeable liners.

Conduit 508 includes one or more fluid jet forming nozzles 514. In some embodiments, fluid jet forming nozzles 514 may be longitudinally spaced along conduit 508 such that when conduit 508 is inserted into well bore 502, fluid jet forming nozzles 514 will be adjacent to zones 516 and 518 in subterranean formation 506. As will be recognized by those of ordinary skill in the art, with the benefit of this disclosure, conduit 508 may have any number of fluid jet forming nozzles, configured in a variety of combinations along and around conduit 508. Optionally, fluid jet forming nozzles 514 may be coupled to check valves 520 (shown in Inset 5A) so as to limit the flow of a fluid (not shown) through fluid jet forming nozzles 514 to a single direction. Optionally, conduit 508 may include one or more window casing assemblies, such as for example illustrative window casing assembly 200 (not shown), adapted so as to selectively allow the communication of a fluid through fluid jet forming nozzles 514.

Illustrative well completion assembly 500 may include a fluid delivery tool 522 disposed therein. Fluid delivery tool 522 may include injection hole 524 and may be connected to the surface 504 via workstring 526. Fluid delivery tool 522 may be secured in conduit 508 with a straddle assembly 528, such that injection hole 524 is isolated from the annulus 530 formed between conduit 508 and workstring 526. Straddle assembly 528 generally should not prevent fluid delivery tool 520 from moving longitudinally in conduit 508.

Figure 5B:
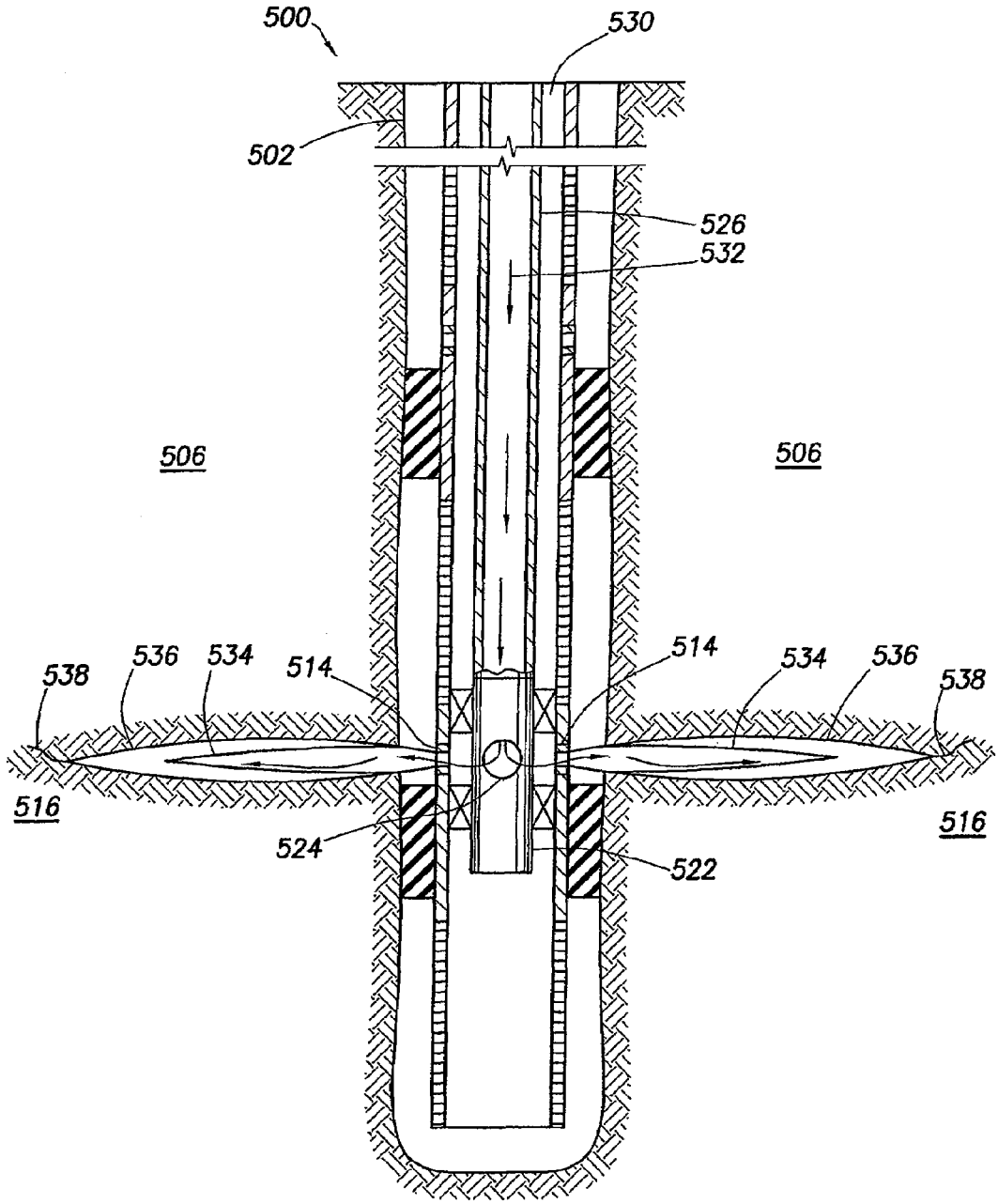

Referring now to FIG. 5B, illustrative well completion assembly 500 is configured to stimulate zone 516. Fluid delivery tool 522 is aligned with fluid jet forming nozzles 514 such that a fluid 532 may be pumped down workstring coil 526, through injection hole 524, and through fluid jet forming nozzles 514 to form fluid jets 534. Returns of fluid 532 may be taken through annulus 530. In one embodiment, fluid 532 is pumped through fluid jet forming nozzles 514 at a velocity sufficient for fluid jets 534 to form perforation tunnels 536. In one embodiment, after perforation tunnels 536 are formed, fluid 532 is pumped into conduit 508 and through fluid jet forming nozzles 514 at a pressure sufficient to form cracks or fractures 538 along perforation tunnels 536.

Optionally, once perforation tunnels 536 have been formed in zone 516, annulus 530 may be closed by any suitable means (e.g., by closing a valve (not shown) through which returns taken through annulus 530 have been discharged at the surface). Closure of annulus 530 may increase the pressure in well bore 502, and in subterranean formation 506, and thereby assist in creating, and extending, cracks or fractures 538 in zone 516. Closure of annulus 530 after the formation of perforation tunnels 536, and continuation of flow exiting fluid jet forming nozzles 514, also may ensure that the well bore pressure will not fall below the fracture closure pressure (e.g., the pressure necessary to maintain the cracks or fractures 538 within subterranean formation 506 in an open position). Generally, upon the initiation of the fracture, the pressure in well bore 502 may decrease briefly (which may signify that a fissure has formed in subterranean formation 506), but will not fall below the fracture propagation pressure. Among other things, flowing fluid through both annulus 530 and through fluid delivery tool 522 may provide the largest possible flow path for the fluid, thereby increasing the rate at which the fluid may be forced into subterranean formation 506.

Figure 5C:
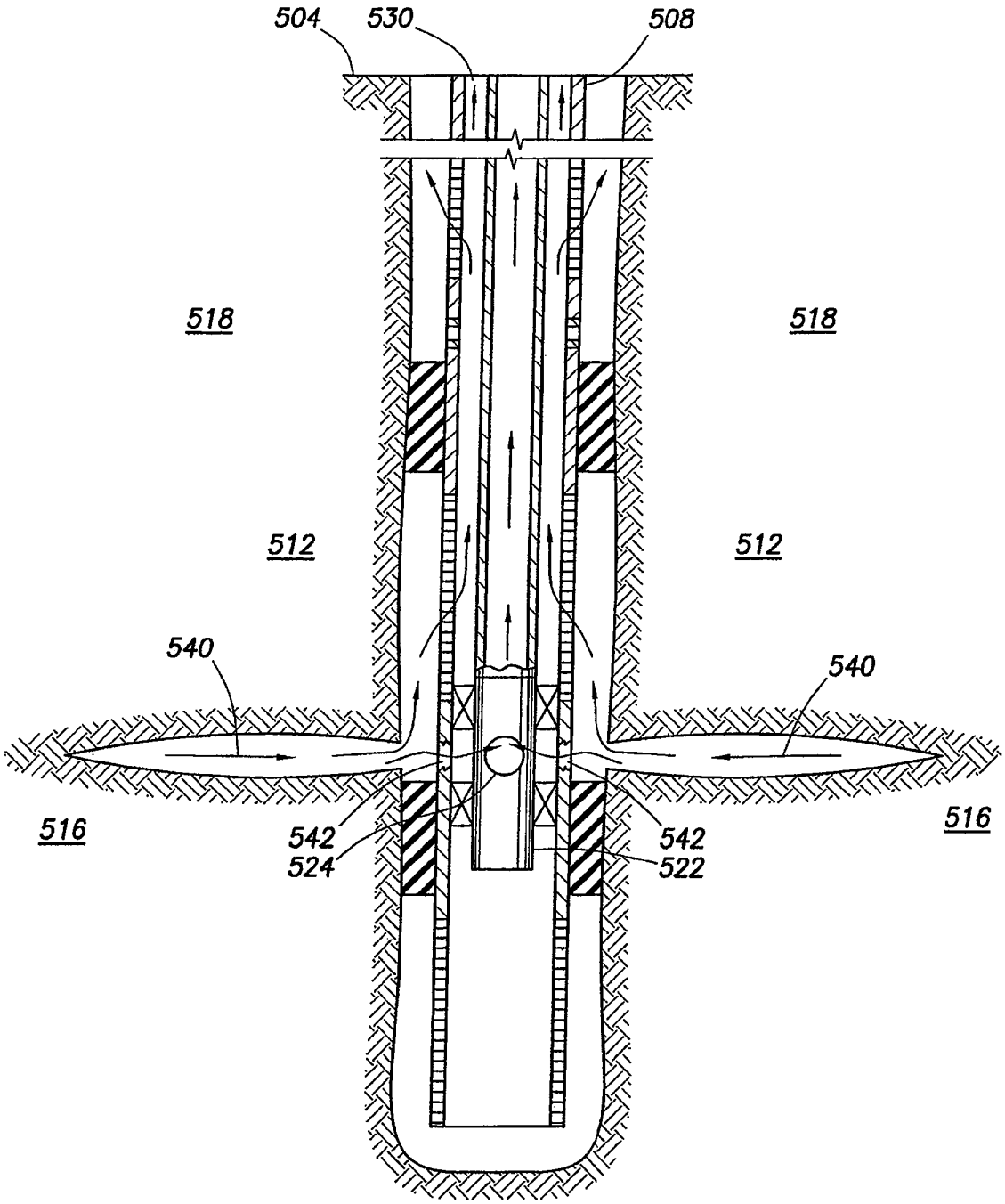

In some embodiments, the fluid jet forming nozzles 514 may be formed of a composition selected to gradually deteriorate during the flow of fluid 532 from conduit 508 into subterranean formation 506. For example, fluid jet forming nozzles 514 may be composed of a material that will degrade during perforation, fracture, acidizing, or stimulation, thereby allowing production fluid 540, shown in FIG. 5C, to flow from subterranean formation 506, through apertures 542, and up conduit 508 to the surface 504. Production fluid 540 may also enter annulus 530 through permeable liner 512 and be returned to the surface 504.

Fluid delivery tool 522 may be moved longitudinally within conduit 508, such that injection hole 524 aligns with fluid jet forming nozzles adjacent to zone 518 (not shown). Completion operations, including perforation, fracture, stimulation, and production, may thus be carried out in zone 518 in isolation from zone 516.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A bottomhole completion assembly comprising:

a conduit adapted for installation in a well bore in a subterranean formation;

one or more fluid jet forming nozzles disposed about the conduit;

a fluid delivery tool disposed within the conduit, wherein the fluid delivery tool is operable to move along the conduit;

a straddle assembly operable to substantially isolate the fluid delivery tool from an annulus formed between the fluid delivery tool and the conduit; and wherein the conduit comprises one or more permeable liners.

2. The assembly of claim 1 further comprising one or more apertures formed in the conduit and adapted to selectively allow a flow of a fluid through at least one of the one or more fluid jet forming nozzles.

3. The assembly of claim 1, wherein the conduit is secured in the well bore, so as to create a plurality of zones in the subterranean formation.

4. The assembly of claim 2, wherein the conduit is secured with one or more casing packers disposed in an annulus between the conduit and the well bore.

5. The assembly of claim 2, wherein the conduit is secured with a cement composition disposed in an annulus between the conduit and the well bore.

6. The assembly of claim 3, wherein at least one of the plurality of zones includes at least one of the one or more fluid jet forming nozzles and at least one of the one or more permeable liners.

7. A method of bottomhole completion in a subterranean formation comprising:

providing a conduit adapted for installation in a well bore in a subterranean formation;

providing one or more fluid jet forming nozzles disposed about the conduit;

providing a fluid delivery tool disposed within the conduit, wherein the fluid delivery tool is operable to move along the conduit; providing a straddle assembly operable to substantially isolate the fluid delivery tool from an annulus formed between the fluid delivery tool and the conduit, wherein the conduit comprises one or more permeable liners; and conducting a well completion operation.

8. The method of claim 7 further comprising providing one or more apertures adapted to selectively allow a flow of a fluid through the one or more fluid jet forming nozzles.

9. The method of claim 7, wherein the conduit is secured in the well bore so as to create a plurality zones in the subterranean formation.

10. The method of claim 9, further comprising providing one or more casing packers in an annulus between the conduit and the well bore, so as to secure the conduit in the well bore.

11. The method of claim 9, further comprising providing a cement composition in an annulus between the conduit and the well bore, so as to secure the conduit in the well bore.

12. The method of claim 9, wherein at least one of the plurality of zones includes at least one of the one or more fluid jet forming nozzles and at least one of the one or more permeable liners.

* * * * *